US007681369B2

(12) United States Patent
Soltesiz et al.

(10) Patent No.: US 7,681,369 B2
(45) Date of Patent: Mar. 23, 2010

(54) DOUBLE PANE WINDOW CONSTRUCTION

(76) Inventors: Joseph R. Soltesiz, 2330 Harbour Oaks Dr., Longboatkey, FL (US) 34228; Nanette M. Soltesiz, 2330 Harbour Oaks Dr., Longboatkey, FL (US) 34228

( * ) Notice: Subject to any disclaimer, the term of this patent is extended or adjusted under 35 U.S.C. 154(b) by 269 days.

(21) Appl. No.: 11/892,309

(22) Filed: Aug. 21, 2007

(65) Prior Publication Data

US 2008/0047208 A1 Feb. 28, 2008

Related U.S. Application Data

(60) Provisional application No. 60/839,128, filed on Aug. 22, 2006.

(51) Int. Cl.
*E06B 3/64* (2006.01)

(52) U.S. Cl. ..... 52/456; 52/786.1; 52/204.593

(58) Field of Classification Search ..... 52/204.59, 52/204.593, 204.595, 204.61, 456, 786.1, 52/786.11, 786.13; 428/34
See application file for complete search history.

(56) References Cited

U.S. PATENT DOCUMENTS

| | | | | |
|---|---|---|---|---|
| 3,308,593 | A | 3/1967 | Smith | |
| 3,791,095 | A | 2/1974 | Martin | |
| 4,021,967 | A | 5/1977 | Mulder et al. | |
| D248,670 | S | 7/1978 | March | |
| 4,204,015 | A | 5/1980 | Wardlaw et al. | |
| 4,479,988 | A | 10/1984 | Dawson | |
| 4,652,472 | A | 3/1987 | Davies | |
| 4,783,938 | A * | 11/1988 | Palmer | 52/171.3 |
| 4,872,498 | A | 10/1989 | De Block et al. | |
| D305,069 | S | 12/1989 | De Block et al. | |
| 4,884,376 | A | 12/1989 | De Block et al. | |

(Continued)

FOREIGN PATENT DOCUMENTS

| | | |
|---|---|---|
| DE | 3330709 | 3/1985 |

(Continued)

OTHER PUBLICATIONS

Website, http://www.bigbluewindow.com, home page for Big Blue Window, external window muntin pattern illustrated. Two pages printed from the internet on Apr. 11, 2006.

(Continued)

*Primary Examiner*—Robert J. Canfield
*Assistant Examiner*—Christine T Cajilig
(74) *Attorney, Agent, or Firm*—Richard C. Litman

(57) ABSTRACT

The double pane window construction includes an inner peripheral surround captured between two panes of glass immediately adjacent the outer peripheral seal of the assembly. The surround has a width sufficient to conceal the inner surface of the seal from the view when the interior of the assembly is viewed at an acute angle through the glass, but includes a circulation gap between each edge thereof and the adjacent glass pane to allow the air or gas entrapped between the panes to communicate with the seal and any dessiccant material therewith. The surround includes a seal attachment flange for attachment to the seal, and may have a faux muntin pattern formed integrally therewith. The surround and faux muntin grid may be formed of plastic or other suitable material in any practicable size and pattern. The assembly is particularly well suited as a door lite.

15 Claims, 4 Drawing Sheets

U.S. PATENT DOCUMENTS

| | | | | |
|---|---|---|---|---|
| 4,890,435 | A | 1/1990 | Wilkening et al. | |
| 4,890,438 | A | 1/1990 | Tosa et al. | |
| 4,897,975 | A | 2/1990 | Artwick et al. | |
| 4,920,718 | A | 5/1990 | Artwick et al. | |
| 4,951,927 | A | 8/1990 | Johnston et al. | |
| 4,989,381 | A | 2/1991 | De Block et al. | |
| 5,105,597 | A | 4/1992 | Wilkening | |
| 5,112,175 | A | 5/1992 | Wilkening | |
| 5,133,168 | A | 7/1992 | Neilly et al. | |
| 5,249,403 | A | 10/1993 | Neilly et al. | |
| D350,400 | S | 9/1994 | De Block et al. | |
| 5,436,040 | A | 7/1995 | Lafond | |
| 5,494,715 | A | 2/1996 | Glover | |
| 5,544,455 | A | 8/1996 | DeBlock | |
| 5,636,484 | A | 6/1997 | DeBlock | |
| 5,644,881 | A | 7/1997 | Neilly | |
| 5,678,377 | A * | 10/1997 | Leopold | 52/656.9 |
| 5,765,325 | A | 6/1998 | DeBlock | |
| 5,834,124 | A | 11/1998 | Pease, III et al. | |
| 6,138,433 | A | 10/2000 | Ridge | |
| 6,148,563 | A | 11/2000 | Roche et al. | |
| 6,151,849 | A | 11/2000 | Twigg et al. | |
| 6,266,940 | B1 | 7/2001 | Reichert | |
| 6,311,455 | B1 | 11/2001 | Gerard | |
| 6,345,485 | B1 * | 2/2002 | Boone et al. | 52/786.13 |
| 6,546,682 | B1 | 4/2003 | DeBlock et al. | |
| D482,799 | S | 11/2003 | Alexander | |
| 6,743,489 | B2 | 6/2004 | Compton et al. | |
| 6,817,146 | B2 | 11/2004 | Jasperson | |
| 6,922,946 | B2 | 8/2005 | Gerard | |
| 6,925,767 | B2 | 8/2005 | Krochmal et al. | |
| 2003/0074859 | A1 | 4/2003 | Reichert et al. | |
| 2003/0145532 | A1 | 8/2003 | Kownacki et al. | |
| 2003/0230045 | A1 | 12/2003 | Krause, Sr. et al. | |
| 2004/0031234 | A1 | 2/2004 | Emde | |

FOREIGN PATENT DOCUMENTS

| | | |
|---|---|---|
| EP | 475213 | 3/1992 |
| GB | 2137680 A * | 10/1984 |
| WO | WO 9325774 | 12/1993 |

OTHER PUBLICATIONS

Website, http://www.bristolwindows.com/HTML_Pages/door.htm, series of entry doors pictured, two pages printed from the internet on Apr. 11, 2006.

* cited by examiner

DOUBLE PANE WINDOW CONSTRUCTION

CROSS-REFERENCE TO RELATED APPLICATION

This application claims the benefit of U.S. Provisional Patent Application Ser. No. 60/839,128, filed Aug. 22, 2006.

BACKGROUND OF THE INVENTION

1. Field of the Invention

The present invention relates generally to window construction. More specifically, the present invention relates to a double pane window construction for buildings.

2. Description of the Related Art

The ability to form glass in relatively large sheets has been developed only in relatively recent times. Historically, early glass windows were formed of a number of relatively small panes of glass secured together by a muntin structure of relatively thin crossmembers extending across the frame. This construction, along with historically low energy costs, precluded the development of better insulated glass panels until relatively recent times.

More recently, the poor insulating quality of glass has been recognized, and a number of different window construction configurations have been developed in order to respond to this property of glass. All of the insulating glass panels of which the present inventors are aware use at least two (and sometimes more) sheets of glass containing one (or more) insulating spaces of air or other gas between the panes. Such double (or more) glass pane configurations are now commonly used in windows and in glass installations in doors, i.e., door lites.

One common double pane window construction configuration involves the use of a soft, rubberized peripheral seal between two panes of glass, with the seal serving to space the two panes apart to provide an insulating airspace therebetween and also sealing the air or other gas between the two panes to prevent moisture from infiltrating the airspace and forming condensation between the panes. The soft sealing material is generally impregnated with a desiccant material to absorb any moisture that does become entrapped between the panes, and may also include a rigid metal member extending laterally thereacross to limit lateral compression of the seal and to space the two glass panes properly relative to one another during the assembly process. This sealing material is known as a "Swiggle"®, and is manufactured by the TruSeal Corporation. Other sealing means providing essentially the same functions may also be employed.

One of the drawbacks to the use of the "Swiggle"® sealant material is its visibility between the peripheries of the two glass panels in the completed assembly. While the surrounding frame conceals the periphery of the glass and the seal from direct view from outside the assembly, the seal may still be visible when looking through the glass assembly at an acute angle. While the Swiggle® seal may be provided in a relatively few different colors, these colors generally do not match the frame of the completed window structure or other components associated with the insulated window assembly.

While structural muntins are not required where relatively large, continuous glass panes are used, particularly in the case of double pane insulated glass window assemblies, muntins form an attractive architectural detail that is desired and appreciated by many, regardless of the specific type of window construction. As a result, faux muntins have been developed, which are installed between the two panes of glass in an insulated window construction. These faux muntins do not support the glass in any manner, but form a purely decorative architectural detail or element.

However, another problem with the use of the relatively soft Swiggle® material as the peripheral seal in an insulated window assembly is that it does not provide a great deal of support for such faux muntins or other decorative elements captured between the glass panes. Any such elements must be carefully engineered for the peripheral seal to support them securely between the glass panes without allowing the elements to shift out of position. If such a positional shift occurs, the result cannot be repaired without breaking the seal and disassembling the double pane glass assembly.

It will be seen that the need for air or gas circulation between the two panes of a double pane window assembly (to allow the air or gas to contact the peripheral desiccant material), requires a relatively thin faux muntin configuration where such faux muntins are used. This is at odds with the desirability to conceal the peripheral sealant used to seal the airspace between the two glass panes.

The present inventors are aware of various attempts in the related art to overcome various deficiencies in double pane window construction, but are aware of none that address the specific problems noted above. An example of such is found in German Patent No. 3,330,709, published on Mar. 21, 1985, which is directed to means for reinforcing the latch area of the frame for a casement window. A frame having a complex cross section is disclosed in the drawings, with the frame being secured to the periphery of a double pane window. The sealing means for the two panes of the double pane window is a relatively hard and rigid seal, rather than the relatively soft and pliable Swiggle® or equivalent seal used with the present window construction invention.

Thus, a double pane window construction solving the aforementioned problems is desired.

SUMMARY OF THE INVENTION

The double pane window construction includes an inner peripheral surround immediately inboard of the outer peripheral seal for the two panes of glass. The surround is attached to the seal, and has a width slightly less than the space between the two panes of glass. Thus, air or other gas entrapped between the two sealed panes can circulate past the surround to communicate with the seal and any desiccant material disposed with the seal. However, the surround has a width extending across the majority of the space between the two panes of glass in order to conceal the seal from view when the interior of the assembly is viewed at an acute angle through the glass.

As an example of the above, if the spacing between the two panes of glass is about 0.750 inch, the width of the surround may be about 0.550 inch, thereby providing a circulation gap of about 0.100 inch between each edge of the surround and the adjacent glass. It will be seen that the above dimensions are exemplary and may be adjusted in accordance with the specific double pane glass assembly. It should also be noted that while it is desirable that the surround be centered between the two panes of glass, that the surround need not be perfectly centered between the two panes.

The surround also provides for the integral formation of faux muntins therewith, if so desired. Such faux muntins are not structural members supporting separate glass panes, but serve as decorative components between the two glass panes of the assembly. The faux muntins are preferably thinner than the width of the surround in order to provide a realistic appearance and to allow as much circulation as possible therearound. The faux muntins are preferably formed integrally with the surround as a single, unitary, monolithic casting of plastic or other suitable material. The surround also preferably includes an outwardly facing flange to facilitate attachment to the Swiggle® or other peripheral seal used. The flange may incorporate some form of seal gripping means therealong.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a double pane window construction, differing in details of the peripheral surround, which encloses and defines the viewing area through the glass panes. The double pane window construction may be installed in any practicable location, but is particularly well suited for use as a door lite installation.

Figure 1:
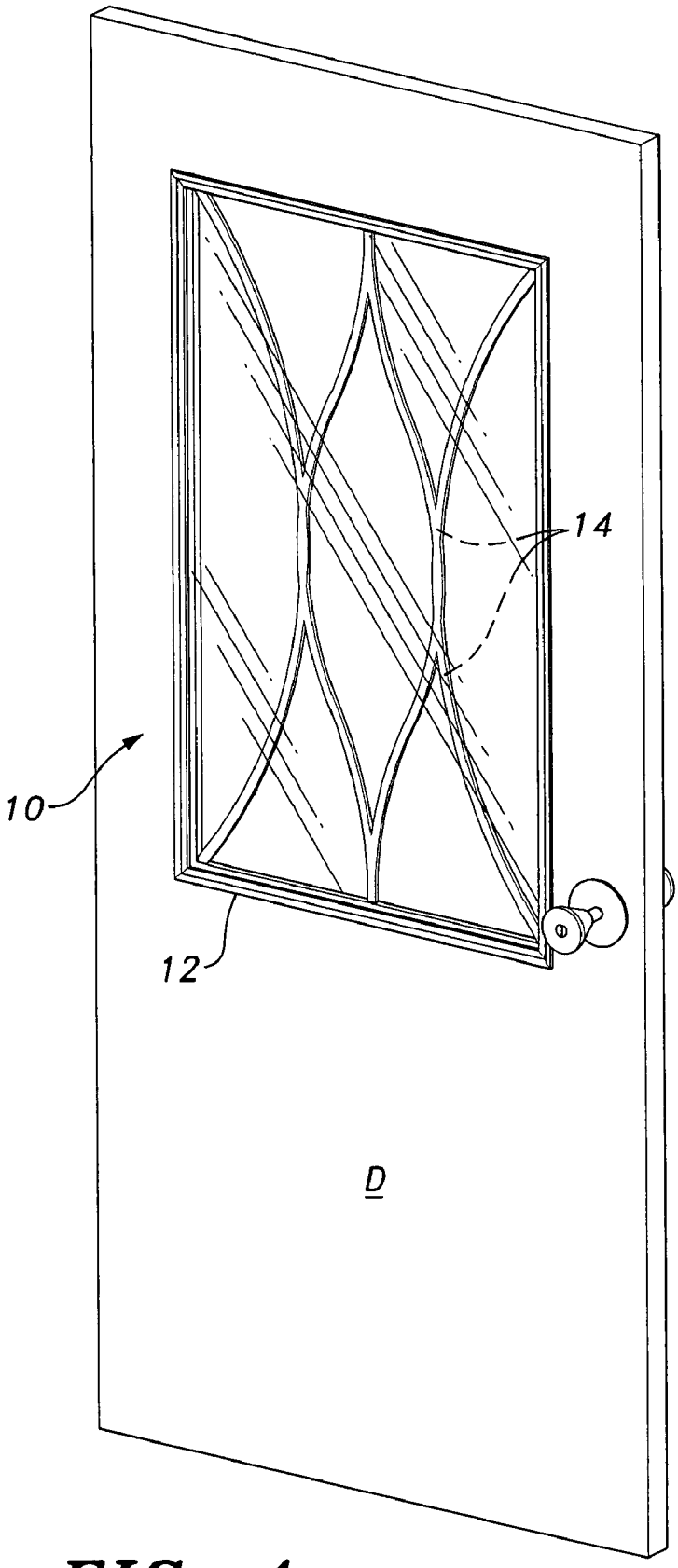
FIG. 1 is an environmental, perspective view of a door incorporating a double pane window according to the present invention.

FIG. 1 of the drawings provides an exemplary illustration of such a door lite 10 installed within a door D. A frame assembly 12 secures the door lite assembly 10 within the door D. The door lite assembly 10 includes a faux muntin grid 14 therein, i.e., the faux muntin is not a structural member of the assembly but provides a decorative architectural element to the door lite assembly 10.

Figure 2:
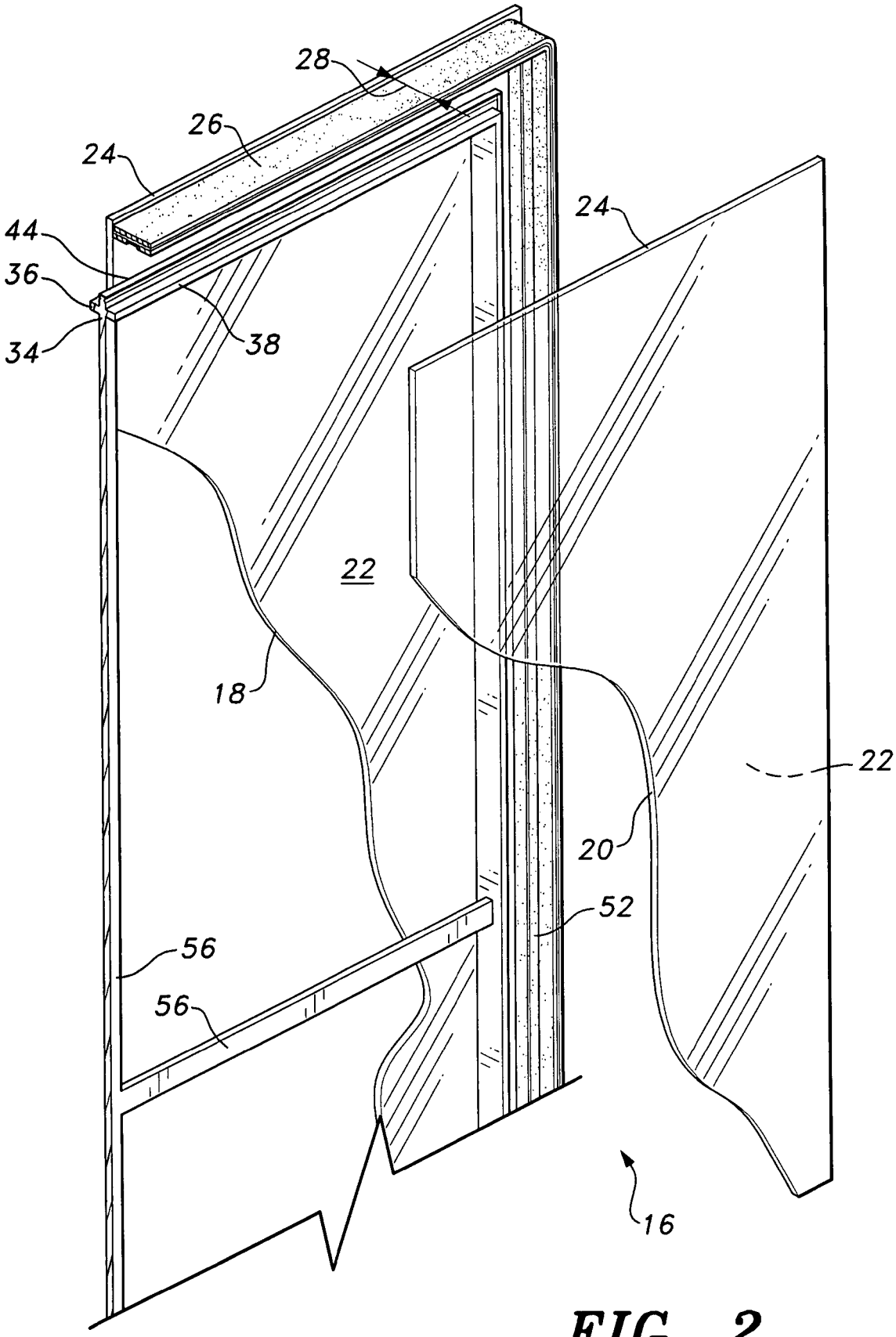
FIG. 2 is a broken away, exploded detail perspective view of a corner of the double pane window assembly according to the present invention, showing various details thereof.
Figure 3:
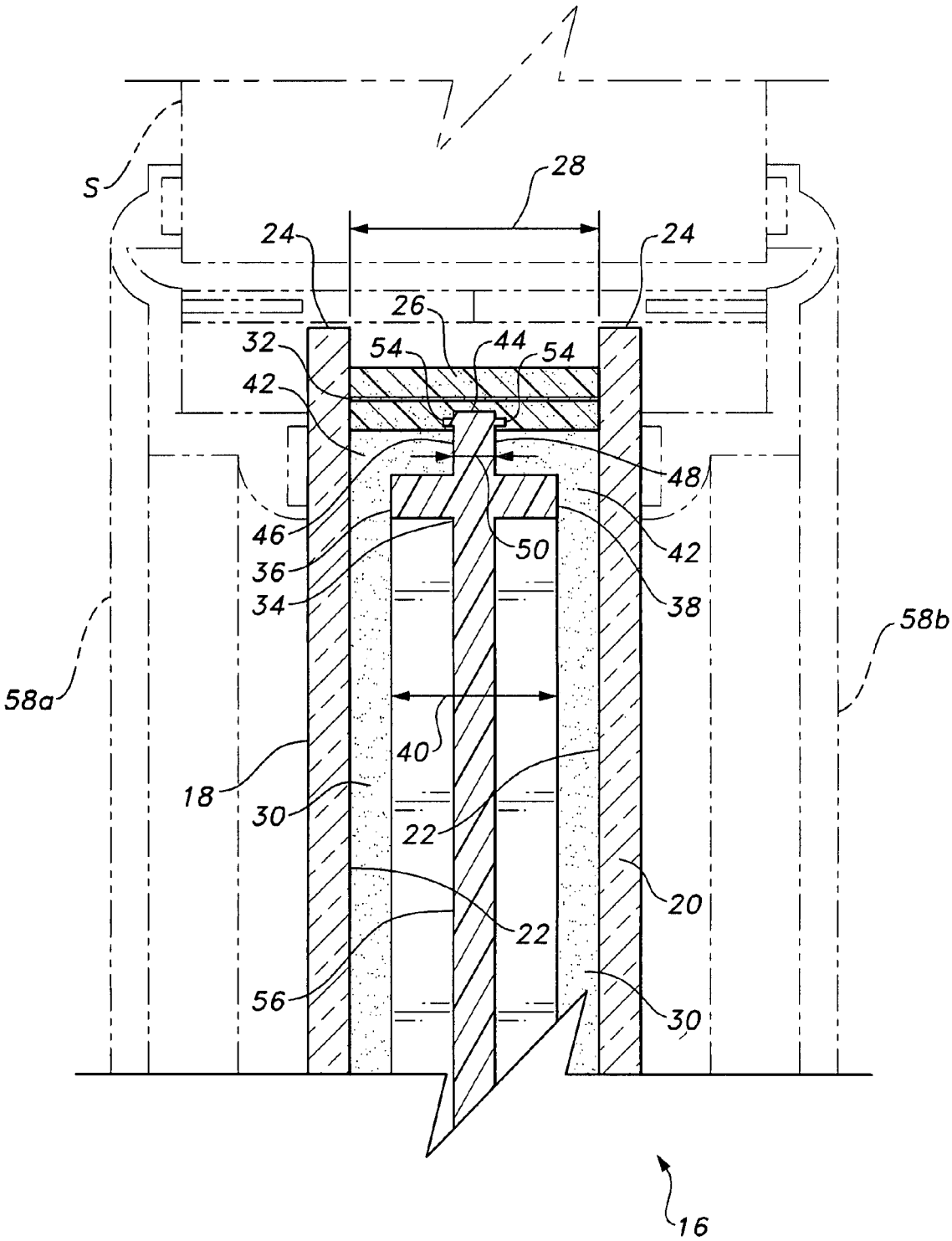
FIG. 3 is a detail view in section of a completed double pane window assembly of the present invention, showing the relationship of the components.

FIG. 2 of the drawings provides an exploded detail perspective view of a portion of an exemplary double pane window construction 16, with FIG. 3 illustrating the completed assembly of FIG. 2 in cross section. The double pane window construction 16 of FIGS. 2 and 3 is similar to the door lite 10 of FIG. 1, differing only in the decorative faux muntin pattern or configuration and the lack of limitation to a door lite assembly for the double pane construction 16 of FIGS. 2 and 3.

The double pane window assembly 16 of FIGS. 2 and 3 includes a first pane of glass 18 and an opposite second pane of glass 20 spaced apart from and parallel to the first pane 18, with each of the panes having at least an inner surface 22 and a periphery 24. A soft, elastomeric seal 26 is adhesively disposed between the peripheries 24 of the two panes 18 and 20, hermetically sealing against the inner surfaces 22 of the panes and precluding air or gas flow to or from the interior volume defined by the two panes 18 and 20 and the seal 26. The seal 26 has a compressed width 28, with the areas of the two glass panes 18 and 20 extending across the span of the peripheral seal 26 and the width 28 of the seal 26 defining an interior insulating air gap 30 for the double pane window construction 10.

The seal 26 is primarily formed of a relatively soft material, and as such it cannot hold its shape when compressed, as occurs during the manufacturing process for the double pane window assembly 10 or 16. Accordingly, the seal 26 includes a thin metal stiffening element 32 which extends laterally across the width 28 of the seal, with the stiffening element 32 preventing the lateral collapse of the seal 26 and defining the width 28 of the seal 26 and corresponding space or distance between the inner surfaces 22 of the two glass panes 18 and 20. The seal 26 is also preferably impregnated or otherwise provided with a conventional desiccant material incorporated therein in order to absorb any moisture that may be present in the air or gas captured between the two panes 18 and 20. An exemplary seal which meets all of the above characteristics is known as the "Swiggle®," and is manufactured by the Tru-Seal Corporation. Other sealing means providing essentially the same functions may also be employed with the present invention.

A peripheral surround 34 is installed between the peripheral portions 24 of the two glass panes 18 and 20, immediately inwardly from the outer peripheral seal 26. The surround 34 comprises a seal-concealing flange having opposite first and second edges, respectively 36 and 38, which define a surround width 40, which is somewhat less than the width 28 of the seal 26. This results in a circulation gap or distance 42 between each surround edge 36 and 38 and the corresponding glass pane 18 and 20. Yet, the relatively wide width 40 of the surround 34, being only slightly narrower than the space or gap 28 between the two panes of glass 18 and 20, serves to substantially conceal the inner surface of the seal 26 from view when the surround 34 is viewed at an acute angle through either of the glass panes 18 or 20 and provides a finished look for the interior of the double pane glass assembly 10 or 16.

The surround 34 also includes a seal attachment flange 44 extending outwardly normal to the seal-concealing flange to form a T-shape, with the seal attachment flange 44 being secured to the inner surface of the seal 26 (by adhesive, by heat sealing, by simple compression of the seal 26, or by any other means) to hold the surround 34 in place between the two glass panes 18 and 20. The seal attachment flange 44 extends outwardly from the seal-concealing flange, forming the shaft of the T-shaped surround 34, and serves to space the surround 34 from the seal 26 to provide a circulation gap therebetween.

The seal attachment flange 44 includes opposite first and second lateral faces, respectively 46 and 48, which define a seal contact width 50 considerably less than the width 40 of the surround 34. The relatively narrow seal contact width 50, along with the spacing of the surround 34 from the surface of the seal 26 by means of the height of the seal attachment flange 44 from the outboard surface of the surround 34, results in a relatively large amount of the interior surface of the seal 26 being exposed to the internal insulating air gap 30 captured between the two glass panes 18 and 20 and the peripheral seal 26, even though the seal 26 is essentially concealed from view by the surround 34 spaced apart therefrom. This exposes more of the desiccant material disposed in the seal 26 to the air or other gas captured in the insulating air gap 30, thereby providing more efficient absorption of any moisture, which may be captured within the air gap 30.

It will be noted in FIG. 2 that the interior surface of the seal 26 is provided with a shallow channel or groove 52 therein in which the top or head of the seal attachment flange 44 is seated during assembly, forming a tongue-and-groove joint. The seal 26 material is relatively soft and pliable, as noted further above, and will tend to flow around the top or head of the seal attachment flange 44 when pressure and/or heat is applied to seat and seal the flange 44 in the seal groove 52. Better adhesion between the seal 26 and seal attachment flange 44 of the surround 34 may be achieved by providing some form of irregularity to each of the lateral faces 46 and 48 of the seal attachment flange 44. The relatively soft material of the seal 26 flows around or into the irregularity (ridge, groove, etc.), thereby tending to encapsulate the outer portion or head of the seal attachment flange 44 within the seal 26.

Figure 4A:
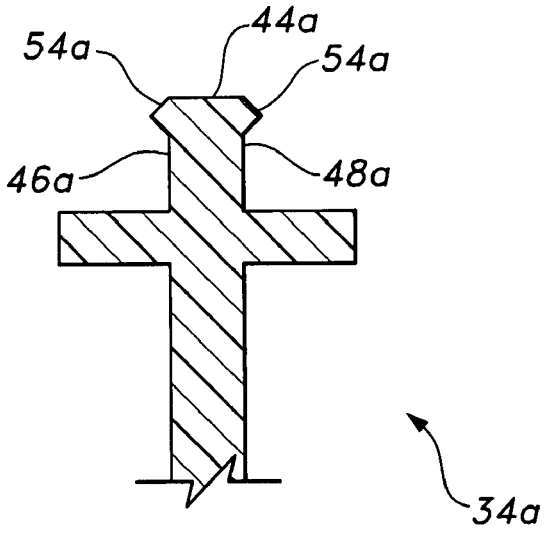
FIGS. 4A and 4B illustrate cross sectional views of alternative configurations for the surround portion of the present double pane window construction.
Figure 4B:
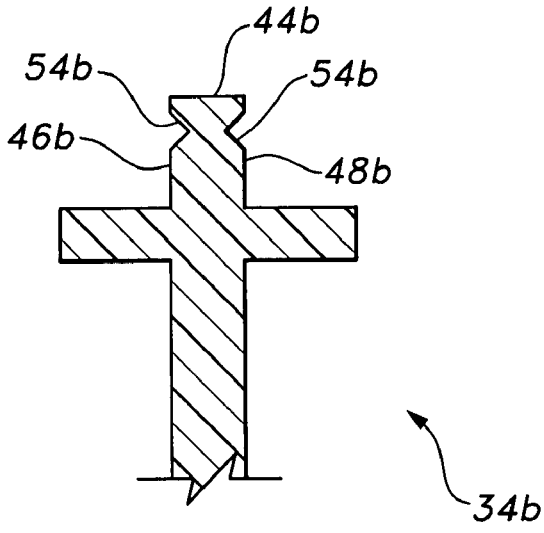

FIG. 3 illustrates an example of such an irregularity, comprising a seal gripping ridge 54 having a rectangular cross section disposed along each of the lateral faces 46 and 48 of the seal contact flange 44. Alternative surround cross sections are illustrated in FIGS. 4A and 4B, with the surround 34*a* of FIG. 4A having opposed seal gripping ridges 54*a* of triangular cross section disposed upon the two lateral faces 46*a* and 48*a* of the seal attachment flange 44*a*, and the surround 34*b* of FIG. 4B having opposed seal gripping channels or grooves 54*b* of triangular cross section formed in the two lateral faces 46*b* and 48*b* of the seal attachment flange 44*b*. The three seal gripping means illustrated in FIGS. 3 through 4B are exemplary, and form only three of myriad different continuous and discontinuous forms, shapes, or patterns that such seal gripping means may take.

In addition to concealing the interior surface of the Swiggle® or other seal 26 used in the double pane window construction, the surround 34 (or any of its other alternative embodiments) may provide an additional benefit as well. It will be noted that each of the surround embodiments shown in the drawings includes a faux muntin grid or pattern formed integrally therewith. In the door lite assembly 10 of FIG. 1, the faux muntin pattern 14 comprises a series of curved bows or arcuate segments extending through the insulating volume between the two glass panes from opposite faces of the surround 34 captured therein. In FIG. 2, the faux muntin 56 comprises a rectangular grid. It will be appreciated that these two muntin patterns 14 and 56 are but two of myriad different patterns, grids, or configurations that may be incorporated with the surround 34 of the double pane window construction of the present invention. The specific faux muntin pattern selected is not critical to the invention, and primarily serves as a decorative architectural element captured between the two glass panes of the assembly.

However, the faux muntin grid may also provide some additional structural stiffening of the surround 34 across the insulating volume between the two glass panes 18 and 20. As the surround 34 is preferably molded or cast of plastic, it will be appreciated that the mold structure may be configured to form virtually any practicable faux muntin pattern desired along with the surround at the time of manufacture, e.g., various geometric patterns, floral and other natural designs, symbols and other representations of various articles and concepts, caricatures and representations of actual, fictional, and/or mythical characters and creatures, etc. The surround and its faux muntin are preferably molded of plastic as a single, monolithic, unitary component, as indicated by the continuous cross hatching of the surround 34 and its faux muntin grid 56 in the cross sectional view of FIG. 3.

Preferably, the faux muntin 56 is relatively thin, i.e., considerably thinner than the width of the surround 34, as illustrated in the cross sectional view of FIG. 3. This provides less restriction for air or gas circulation within the interior air gap 30 of the glass panes 18, 20 and seal 26, and also reduces the amount of material required for the formation of the surround 34 and faux muntin 56. A relatively thin faux muntin still provides the visual benefits desired in simulating an actual muntin pattern in a multiple pane window assembly. While the faux muntin grid could be formed to have the same width as the peripheral surround 34, it is desired that the faux muntin not be wider than the peripheral surround in order to avoid undue reduction in circulation of air or gas captured within the double pane window assembly.

Although shown in the drawings as being integral with the faux muntin, the surround 34 may be furnished without the faux muntin, as a T-shaped element attached to the seal, either by an adhesive, heat sealing, or by compression of the seal around the seal attachment flange 44 and any seal gripping members 54, 54*a*, 54*b* (when provided), and extending between the periphery of the two glass panes 18 and 20 to conceal the seal 26 while providing sufficient air circulation to reach the surface area of the seal 26 to allow the dessicant incorporated in the seal 26 to remove moisture from the air in the air gap between the panes 18 and 20.

The double pane window assembly is secured within the surrounding structure by a frame assembly. In FIG. 1, the double pane door lite assembly 10 is secured within an opening through the door D by an external frame assembly 12. In FIG. 3, the double pane window assembly 16 is provided with an external frame assembly comprising two mirror image frame components 58*a* and 58*b*, shown in broken lines. The frame components 58*a* and 58*b* surround the peripheries 24 of the two panes 18, of the window assembly 16 and serve to secure the double pane window assembly 16 within an opening cut or formed in the surrounding structure S, e.g., door, wall, etc. The frame assembly, e.g., frame components 58*a*, 58*b*, may be formed of any suitable material, e.g., cast or molded plastic, etc., as desired.

In conclusion, the double pane window construction with its surround serves to substantially conceal the relatively unsightly Swiggle® or other peripheral seal used to seal the two panes of glass to one another, and also provides a circulation gap for air or gas trapped between the two panes to reach the seal with its integral desiccant. Moreover, the surround provides an internal peripheral base or frame for a faux muntin grid or pattern extending across the internal span of the surround and between the two panes of glass of the assembly. The integral formation of the faux muntin grid with the surround greatly simplifies the assembly process for the double pane window construction, thereby reducing labor and associated costs, as well as providing a much more attractive finished assembly. Accordingly, the double pane window construction will prove to be a most desirable component for use in door lites and other locations where double pane insulated windows may be installed.

It is to be understood that the present invention is not limited to the embodiments described above, but encompasses any and all embodiments within the scope of the following claims.

We claim:

1. A double pane window construction, comprising:

a first glass pane having a periphery;

a second glass pane having a periphery, the second glass pane being spaced apart and substantially parallel to the first glass pane;

a soft, elastomeric seal disposed between the peripheries of each of the glass panes and hermetically sealing each of the glass panes to one another, the seal further having a width defining an insulating air gap disposed between each of the glass panes and a groove defined therein;

a peripheral surround secured to the seal and extending inwardly therefrom, the surround being T-shaped and having a seal-concealing flange and a seal attachment flange extending normal to the seal-concealing flange, the seal-concealing flange extending laterally between the glass panes and defining a first edge spaced apart from the first pane of glass, a second edge spaced apart from the second pane of glass, and a surround width less than the width of the seal in order to provide a circulation gap disposed between the flange edges and the glass panes, the seal attachment flange being seated in the groove defined in the seal, the surround substantially concealing the seal from view when the surround is viewed through either of the glass panes; and a faux muntin grid integrally and monolithically formed with the surround, and extending through the insulating air gap between the panes of glass.

2. The double pane window construction according to claim 1, wherein said seal attachment flange has a first lateral face and a second lateral face opposite the first lateral face, the first lateral face and second lateral face defining a width therebetween less than the width of the surround.

3. The double pane window construction according to claim 2, further including a seal-gripping ridge disposed along each of the lateral faces of said seal attachment flange.

4. The double pane window construction according to claim 2, wherein the first and second lateral faces of said seal attachment flange each have a seal-gripping groove defined therein, the grooves extending across the faces of said seal attachment flange.

5. The double pane window construction according to claim 1, wherein the faux muntin grid has a thickness up to the width of the surround.

6. The double pane window construction according to claim 1, wherein the surround and said faux muntin grid are integrally and monolithically molded of plastic material as a single, unitary component.

7. The double pane window construction according to claim 1, further including an external frame assembly peripherally disposed about the first pane and second pane.

8. The double pane window construction according to claim 1, wherein the first pane, second pane, seal, surround, and faux muntin grid comprise a door lite assembly.

9. A door lite, comprising:

a first glass pane having a periphery;

a second glass pane having a periphery, the second glass pane being spaced apart and substantially parallel to the first glass pane;

a soft, elastomeric seal disposed between the peripheries of the glass panes and hermetically sealing the glass panes to one another, the seal having a width defining an insulating air gap disposed between each of the glass panes, the seal having a groove defined therein;

a peripheral surround having a seal attachment flange seated in the groove defined in the seal and a seal-concealing flange extending normal to the seal attachment flange, the seal-concealing flange having a first edge spaced apart from the first pane of glass, a second edge spaced apart from the second pane of glass, and a surround width less than the width of the seal and defining a circulation gap disposed between the seal-concealing flange and each of the glass panes, the seal-concealing flange being spaced above the seal and concealing the seal from view when the surround is viewed through either of the glass panes; and an external frame assembly peripherally disposed about the first pane and second glass panes.

10. The door lite according to claim 9, wherein said seal attachment flange has a first lateral face and a second lateral face opposite the first lateral face, the first lateral face and second lateral face defining a width therebetween less than the width of the surround.

11. The door lite according to claim 10, further including a seal-gripping ridge disposed along each of the lateral faces of said seal attachment flange.

12. The door lite according to claim 10, wherein the first and second lateral faces of said seal attachment flange each have a seal-gripping groove defined therein, the grooves extending across the faces of said seal attachment flange.

13. The door lite according to claim 9, further including a faux muntin grid integrally and monolithically formed with the surround, the faux muntin grid extending through the insulating volume between the panes of glass.

14. The door lite according to claim 13, wherein the faux muntin grid has a thickness up to the width of the surround.

15. The door lite according to claim 13, wherein the surround and faux muntin grid are integrally and monolithically molded of plastic material as a single, unitary component.

* * * * *